US005284270A

United States Patent [19]

Kusta

[11] Patent Number: 5,284,270

[45] Date of Patent: Feb. 8, 1994

[54] LEVER LATCH RING FOR SECURING A COVER PANEL TO A CONTAINER

[75] Inventor: Fred A. Kusta, Birmingham, Ala.

[73] Assignee: Self Industries, Inc., Birmingham, Ala.

[21] Appl. No.: 927,592

[22] Filed: Sep. 15, 1992

Related U.S. Application Data

[63] Continuation of Ser. No. 739,405, Aug. 2, 1991, abandoned.

[51] Int. Cl.[5] ..... B65D 45/34

[52] U.S. Cl. ..... 220/321; 220/354; 220/356; 292/256.69

[58] Field of Search ..... 220/321, 320, 319, 354, 220/356; 292/256.69; 215/276, 275

[56] References Cited

U.S. PATENT DOCUMENTS

| | | | |
|---|---|---|---|
| 2,579,974 | 12/1951 | Scott et al. | 220/321 X |
| 2,884,176 | 4/1959 | Carpenter et al. | 292/256.69 X |
| 3,103,293 | 9/1963 | Beutler | 220/321 |
| 3,204,811 | 9/1965 | Fine | 220/320 |
| 4,413,850 | 11/1983 | Siblik | 292/256.69 |

*Primary Examiner*—Allan N. Shoap

*Assistant Examiner*—Paul A. Schwarz

*Attorney, Agent, or Firm*—Veal & Associates

[57] ABSTRACT

An improved lever latch ring for securing a cover panel having a plurality of tabs thereon to a container wherein the tabs extend beneath an outwardly extending rim forming an upper margin of the container and against an outer wall thereof. The improved lever latch ring includes an arcuate member having a lower horizontal portion that coextends the tabs. The lower horizontal portion is urged against the tabs by a lever latch connected to opposing ends of the arcuate member and when so urged confines the tabs against the outer wall and against a lower portion of the rim. A vertical portion is connected to the lower horizontal portion and extends upwardly therefrom in contact with an outermost portion of the cover panel extending intermediate the vertical portion and the rim. Engagement of the lever latch urges the vertical portion against the cover panel to press the cover panel against the rim. An upper horizontal portion is integrally connected to the vertical portion and extends over the rim and rests on the cover panel to support the lower horizontal portion subjacent the lower portion of the rim.

1 Claim, 3 Drawing Sheets

3
22
11
28
29
27
26
27
24
23
23
29
26
3
28

18
12
17
18
19
19
19
19
21
13
16
14

LEVER LATCH RING FOR SECURING A COVER PANEL TO A CONTAINER

This is a continuation of Ser. No. 07/739,405, filed Aug. 2, 1991, now abandoned.

FIELD OF THE INVENTION

The present invention relates to apparatus for securing a lid or cover panel to a container. In greater particularity the present invention relates to lever latch rings for securing a lid or cover panel having a plurality of tabs or lugs to a container.

BACKGROUND OF THE INVENTION

On Jan. 1, 1991 the United States Government adopted and put into effect The United Nation's Chapter 9 Recommendations for the Transport of Dangerous Goods. This action mandates changes in the heretofore accepted Department of Transportation Regulations for Hazardous Goods.

The change set forth in the United Nations Chapter 9 Recommendations altered the test height from which a container is dropped in determining the sealing integrity of the dropped container. The "drop test" previously required a container to be dropped forty eight inches whereas the United Nation's Recommendations requires the container to be dropped ninety inches. A "hydrostatic test" is also required by the United Nations Recommendations whereby containers must withstand an internal hydrostatic pressure of 37 PSI without leaking.

A container commonly subjected to this test and most widely used for the transportation of generally classified hazardous materials is a cylindrical bucket having a circular bottom a substantially cylindrical outer wall and a circular cover panel. The cover panel extends over a rim defining the upper margin of the bucket and is secured thereto by relatively rigid but malleable tabs that extend beneath the rim and against the outer wall. A securing ring, commonly referred to as a lever latch ring, circumscribes the rim outwardly thereof and is drawn in pressed engagement therewith to press an outermost portion of the cover panel in pressed abutment with the rim. The ring is defined by an arcuate, cross-sectionally C-shaped member substantially forming a circle and a lever latch connected to adjacent opposing ends of the arcuate member for drawing the ends together and thus the arcuate member inwardly toward the rim. The C-shaped, arcuate member is formed by a vertical portion circumscribing the rim and drawn into contact with the outermost portion of the cover panel, an upper horizontal portion extending from an upper margin of the vertical portion above the rim and a lower horizontal portion extending from a lower margin of the vertical portion below the rim. The upper and lower horizontal portions secure the vertical portion proximal the rim but do not exert any pressure on the cover panel or the tabs forming a portion thereof. The securing pressure provided by such lever latch rings is applied only at the outermost point of the cover panel and rim. The lower horizontal portion is actually spaced from the tabs and outer wall.

Though the lever latch ring set forth above has been used for years, it cannot prevent leakage when a hydrostatic pressure of thirty seven PSI is introduced within the container. In fact, it is difficult if not impossible for the aforesaid lever latch ring to sustain a hydrostatic pressure of twenty PSI without experiencing leakage. Obviously such lever latch rings and associated containers will not meet the Department of Transportation's new requirements for hazardous waste materials thus an improved container and lid engaging and sealing apparatus is required.

SUMMARY OF THE INVENTION

It is the principal object of the present invention to provide an improved lever latch ring for securing a cover panel to a container capable of sustaining at least a thirty seven PSI hydrostatic pressure within the container.

Another object of the present invention is to provide an improved lever latch ring for securing a cover panel to a container that will prevent leakage of material from within the container when the container is dropped from a height of at least ninety inches.

In support of the previous object, another object of the present invention is to provide an improved lever latch ring that abuts the cover panel tabs subjacent the container rim and thus maintains those tabs against the outer wall of the container and the lower surface of the rim.

These and other objects and advantages of the present invention are accomplished through the use of an improved arcuate member coextending the rim and having a lower horizontal portion that extends inwardly to contact a plurality of tab members connected to the cover panel of a container. The cover panel rest on a rim of the container and extends therearound to an outermost portion thereof. The tabs, which are substantially rigid but malleable, are integrally connected to the cover panel and extend beneath the rim and in contact with an outer wall of the container. A vertical member coextends the outermost portion of the cover panel and is integrally connected to the lower horizontal portion which extends subjacent the rim to contact the tab. A lever latch is connected to adjacent ends of the arcuate member and selectively pulls the ends together and thus the lower horizontal portion into abutment with the tabs. The tabs are thereby urged against the outer wall and a lower portion of the rim. An upper horizontal portion further forms the arcuate member and extends from an upper margin of the vertical member above the rim to support the arcuate member proximal thereto. The degree of inward extension of the upper horizontal member is not of specific importance; however, the distance between the upper and lower horizontal members is only minimally greater than the vertical diameter of the rim and twice optimally the thickness of the cover panel such that the lower horizontal portion is supported subjacent a lower portion of the rim to urge the tab thereagainst. Space is provided between the upper and lower horizontal portions to accommodate extension of the cover panel and tabs intermediate the rim and arcuate member. The extension of the lower horizontal portion from the vertical portion is crucial and is optimally equal to the horizontal distance from the outermost edge of the rim to the outer wall of the container. Such extension facilitates abutment of the tabs by the lower horizontal portion and compression of the cover panel proximal the outermost portion of the rim by the vertical portion.

BRIEF DESCRIPTION OF THE INVENTION

Apparatus embodying features of the invention are depicted in the accompanying drawings which form a portion of this disclosure and wherein.

DESCRIPTION OF A PREFERRED EMBODIMENT

Figure 1:
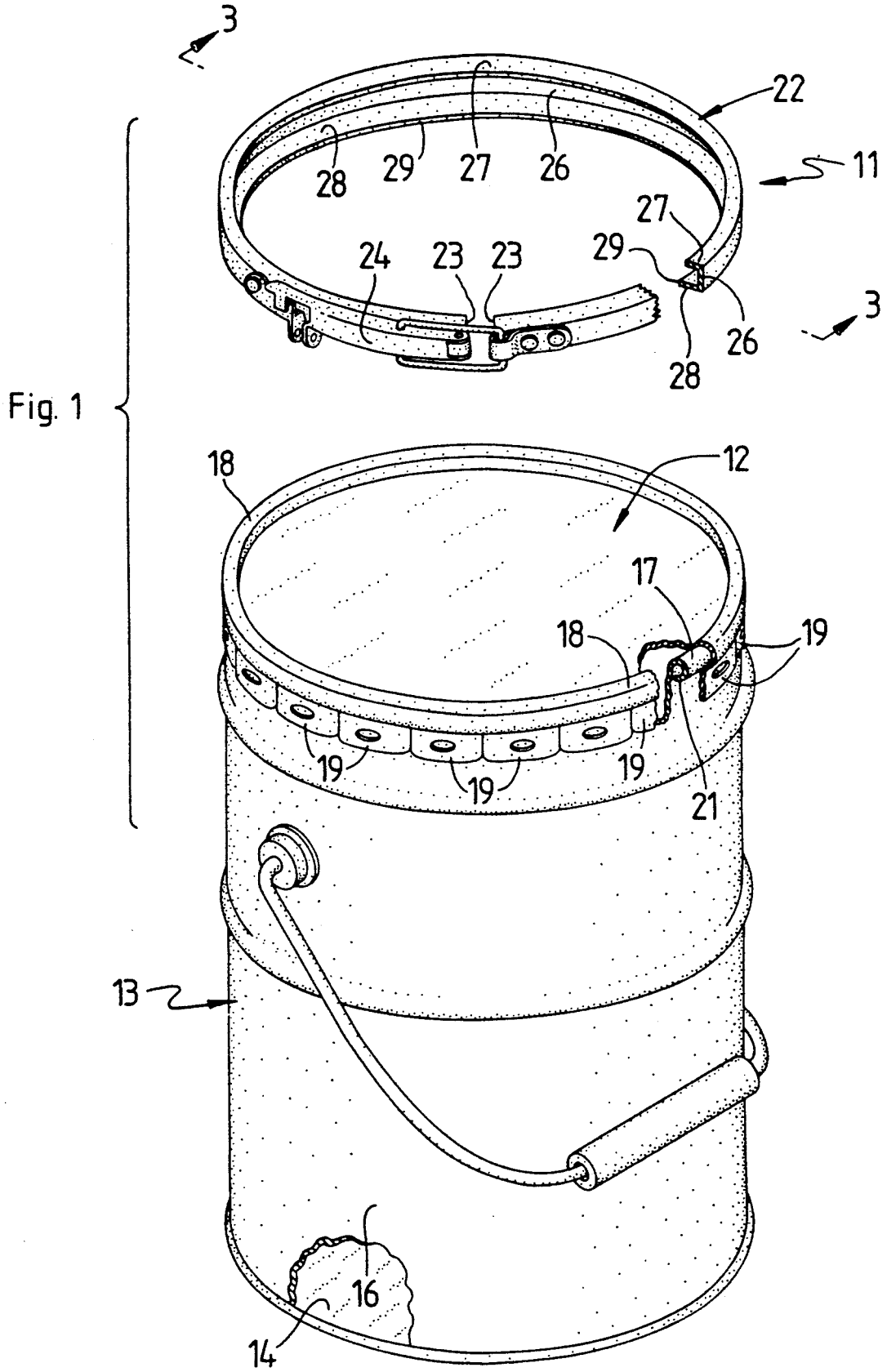
FIG. 1 is an exploded perspective view of the present invention and a container.
Figure 2:
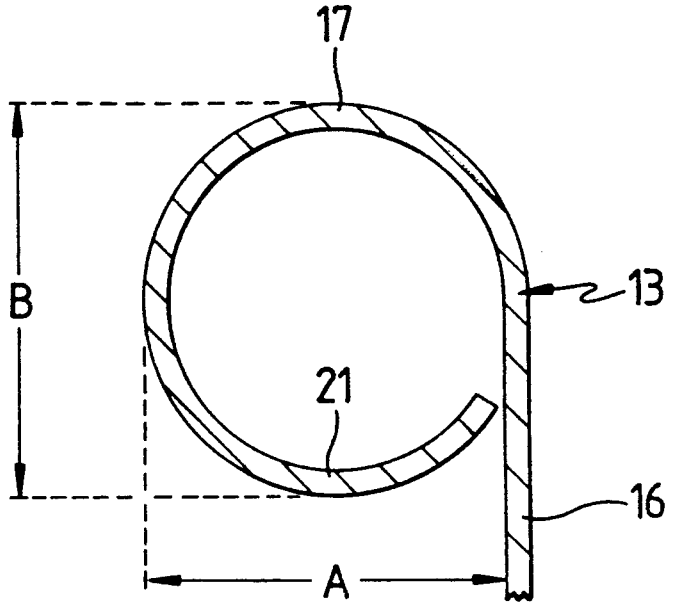
FIG. 2 is an enlarged sectional view of the rim of a container engaged by the present invention.
Figure 4:
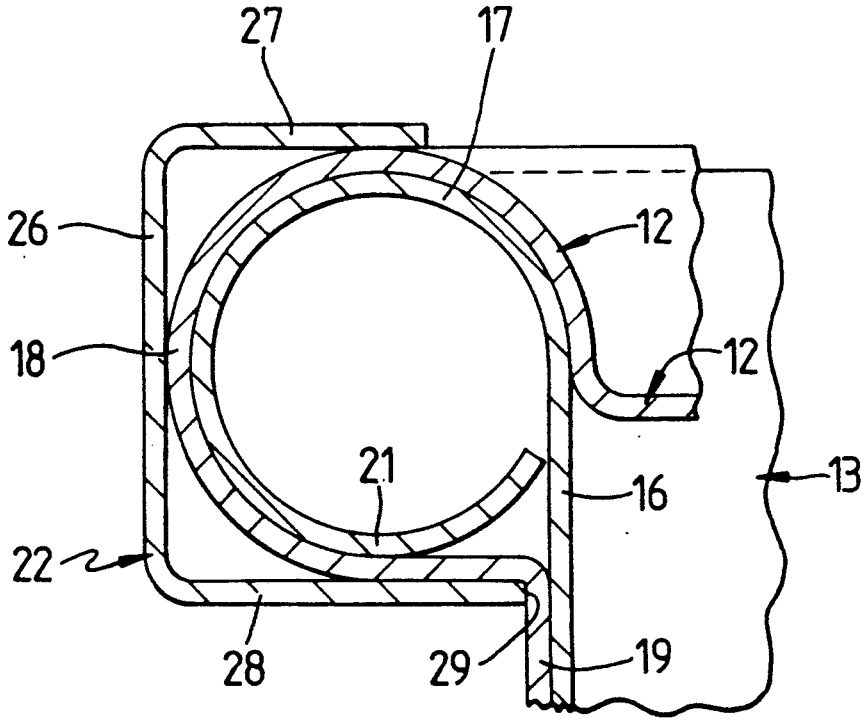
FIG. 4 is an enlarged sectional view of the first embodiment of the present invention engaging the rim.

Referring to the drawings for a clearer understanding of the present invention it should be noted in FIG. 1 that the present invention is an improved lever latch ring 11 used to secure a cover panel 12 to a container 13. The container 13 includes a circular bottom 14 and a substantially cylindrical outer wall 16 connected to the bottom and extending upwardly therefrom. As is shown in FIG. 2, the outer wall 16 is rolled outwardly and under at an upper margin thereof to form a rim 17. The rim 17 is cross-sectionally circular and has a maximum cross-sectional horizontal diameter at A and a maximum cross-sectional vertical diameter at B.

Figure 3:
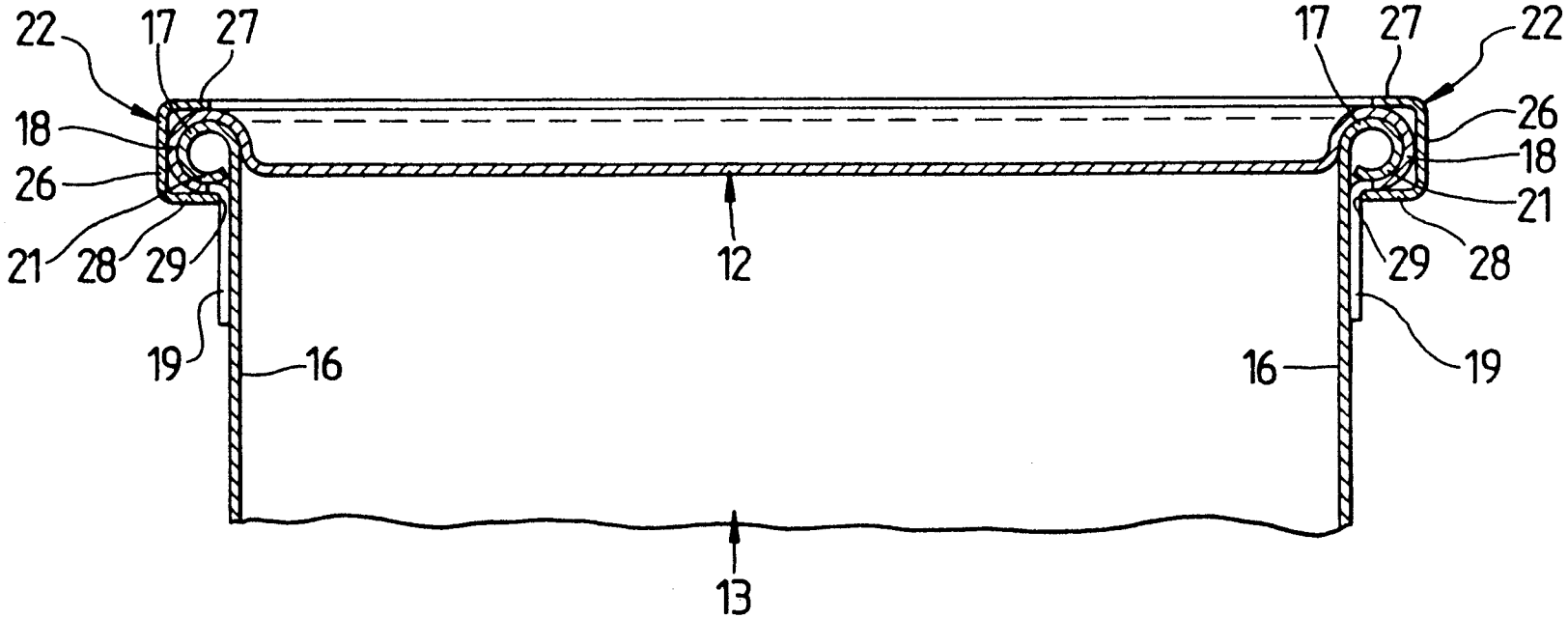
FIG. 3 is a sectional side view of the present invention.

As shown in FIGS. 1, 3 and 6, the cover panel 12 is substantially circular and is supported on the rim 17. The cover panel 12 has an outermost portion 18 that coextends an outermost radial extension of the rim. A plurality of tabs or lugs 19 are integrally connected to the outermost portion 18 and extend downwardly therefrom. The tabs 19 and cover panel 12 are constructed from a substantially rigid but malleable material such as steel or aluminum and extend along a lower portion 21 of the rim 17 and against the outer wall 16.

Figure 5:
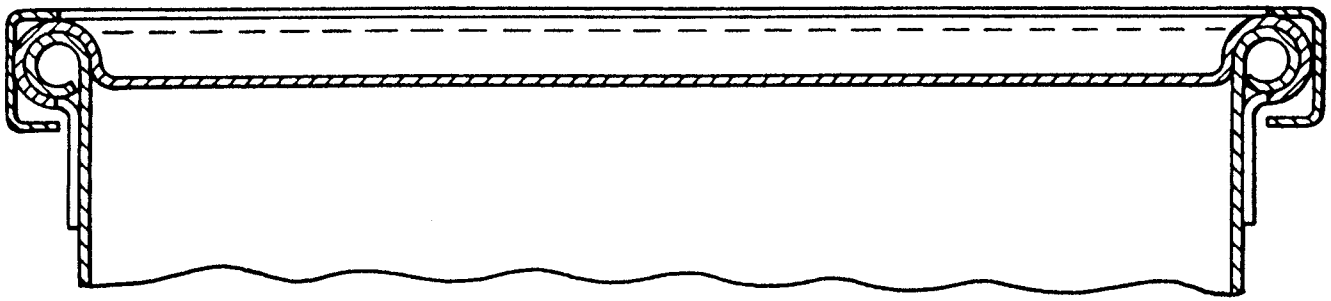
Fig. 5 Prior Art
FIG. 5 is a sectional side view of the prior art.

As shown in FIG. 1, the improved lever latch ring 11 includes an arcuate member 22 extending substantially in a circle and having a pair of adjacent and opposed ends 23. A lever latch- mechanism 24, commonly known in the art, is connected to the ends 23 for purposes discussed hereinafter. The arcuate member 22 is a curved channel member and includes an arcuate vertical portion 26 circumscribing the rim 17 adjacent the outermost portion 18 of the cover panel 12. The vertical portion 26 is supported by an upper horizontal portion 27 integrally connected to the vertical portion and extending over the rim 17 to rest on the cover panel 12. A lower horizontal portion 28 is connected to a lower margin of the vertical portion 26 and extends therefrom subjacent the rim 17 to abut the tabs 19. When the lever latch 24 is engaged, the ends 23 are pulled together and thus urge the arcuate member 22 toward the rim 17. The lower horizontal portion 28 has an inner edge 29 that circumscribes the plurality of tabs 19 such that engagement of the lever latch 24 urges the inner edge 29 against the tabs 19 which have been urged against the outer wall 16 and against the lower portion 21 of the rim 17 by conventional closure methods. Such engagement of the tabs 19 resists upward movement of the cover panel 12 relative to the rim 17. Optimally the lower horizontal portion 28 extends from the vertical portion 26 a distance equal to the horizontal diameter A of the rim 17. This optimal extension, shown in FIGS. 3 and 5, permits the vertical portion 26 to simultaneously contact and urge the outermost portion 18 of the cover panel 12 against the rim 17 concurrently with the contact of the lower horizontal portion 28 against the tabs 19 to further secure the cover panel 12 to the container. It is believed that the improved results obtained with this ring are due to the snug fit against the tabs which cause any opening forces on the cover to overcome a 90 degrees transition. That is to say, the prior art rim had a minimum clearance of 1/16", thus the tabs could move outwardly this distance before encountering the rim thus a general loosening of the seal occurred. In the claimed invention the tabs cannot move radially, thus to be disengaged a radial force applied at the rim must move the tab axially to achieve any loosening of the seal. Consequently a much greater force is required to loosen the tabs. The upper horizontal portion 27 in either embodiment is optimally spaced from the lower horizontal portion 28 a distance equal to the vertical diameter B of the rim 17 plus twice the thickness of the cover panel 12. This spacing supports the lower horizontal portion 28 in pressed abutment with the lower portion 21 of the rim and thus maximizes the securing forces exerted by the inner edge 29 on the tabs 19 when the lever latch 24 is engaged. Note that the spacing of the upper and lower horizontal portions 27 and 28 is not restrictive and that spacing of the horizontal portions can be substantially altered from the optimum distance set forth above as long as the lower horizontal portion 28 is urged against the tabs 19 when the lever latch 24 is engaged. From the foregoing, it should be clear that the present apparatus represents a substantial improvement over the prior art.

While I have shown the invention in two forms, it will be obvious to those skilled in the art that it is not so limited but is susceptible of various changes and modifications without departing from the spirit thereof.

What I claim is:

1. In a container having an upstanding cylindrical outer wall and an outwardly extending upper rim, a cover extending over said rim such that a plurality of malleable tabs extending from said cover are deformed in sealing engagement beneath said rim and against said outer wall beneath said rim, the combination therewith of a lever latch ring comprising an arcuate member having two adjacent and opposing ends circumscribing said rim and defined by an upper horizontal portion resting on said cover, a vertical portion integral with said horizontal portion and a lower horizontal portion integral with said vertical portion and extending therefrom toward said outer wall, wherein said lower horizontal portion extends from said vertical portion toward said tabs a distance at least equal to a maximum horizontal diameter of said rim adjacent said malleable tabs to restrict the outward deformation of said tabs subjacent said rim, and a means for connecting said adjacent opposing ends for retaining said lever latch ring on said container.

* * * * *